US011189111B2

(12) United States Patent
Park et al.

(10) Patent No.: US 11,189,111 B2
(45) Date of Patent: Nov. 30, 2021

(54) VEHICLE IDLE NOTIFICATION SYSTEM AND METHOD

(71) Applicants: Hyundai Motor Company, Seoul (KR); Kia Motors Corporation, Seoul (KR)

(72) Inventors: Yun Joong Park, Seoul (KR); Dong Il Yang, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/788,775

(22) Filed: Feb. 12, 2020

(65) Prior Publication Data

US 2021/0035382 A1 Feb. 4, 2021

(30) Foreign Application Priority Data

Jul. 30, 2019 (KR) ..... 10-2019-0092509

(51) Int. Cl.
*G07C 5/04* (2006.01)

(52) U.S. Cl.
CPC ..... *G07C 5/04* (2013.01)

(58) Field of Classification Search
CPC ..... G07C 5/04; G07C 5/008; B60W 50/14; B60W 10/06; B60W 40/10; B60W 40/08; B60W 30/181; B60W 2520/04; B60W 2040/0881; B60R 25/102; F02D 41/08; B60Y 2300/18091
See application file for complete search history.

(56) References Cited

U.S. PATENT DOCUMENTS

| | | | | |
|---|---|---|---|---|
| 9,754,430 | B1 * | 9/2017 | Wolf | G07C 5/0833 |
| 2004/0055558 | A1 * | 3/2004 | McElroy | B60K 28/04 123/198 DC |
| 2019/0236875 | A1 * | 8/2019 | Stefanelli | B64F 1/32 |

* cited by examiner

*Primary Examiner* — Nabil H Syed
*Assistant Examiner* — Cal J Eustaquio
(74) *Attorney, Agent, or Firm* — Mintz Levin Cohn Ferris Glovsky and Popeo, P.C.; Peter F. Corless

(57) ABSTRACT

A vehicle idle notification system includes a vehicle that transmits idle status information to a server when it is determined that an operation condition of an idle notification timer is satisfied based on a driving state and whether an occupant is detected in the vehicle, and a server that transmits the idle status information to a mobile terminal, thus notifying an idle status of the vehicle to a user, updating a timer setting value for idle notification with a setting value set by the user, storing an idle notification value based on a latest user request information, and stopping the idle at the user's request.

8 Claims, 10 Drawing Sheets

VEHICLE IDLE NOTIFICATION SYSTEM AND METHOD

CROSS-REFERENCE TO RELATED APPLICATION

This application claims under 35 U.S.C. § 119(a) the benefit of Korean Patent Application No. 10-2019-0092509, filed in the Korean Intellectual Property Office on Jul. 30, 2019, the entire contents of which are incorporated herein by reference.

BACKGROUND

(a) Technical Field

The present disclosure relates to a vehicle idle notification system and method.

(b) Description of the Related Art

A vehicle may maintain an engine idle status to use an air conditioner or a heater during engine preheating or stopping. However, if the idle status is maintained for an extended period of time, it produces exhaust gases, which may be harmful to vehicle occupants. In recent years, carbon monoxide poisoning accidents caused by vehicle idling have occurred, so there is a need to notify the vehicle owner of a vehicle idling status and stop idling of the vehicle.

SUMMARY

An aspect of the present disclosure provides a vehicle capable of notifying an idle status of a vehicle according to a driving state of the vehicle or whether an occupant is detected in the vehicle, updating a timer setting value for notification of the idle status with a setting value set by the occupant/user, and storing an idle notification based on the latest user request information and a vehicle idle notification system and method therefor.

According to an aspect of the present disclosure, a vehicle idle notification system includes a vehicle that transmits idle status information to a server when it is determined that an operation condition of an idle notification timer is satisfied based on a driving state and whether an occupant is detected in the vehicle, and the server that transmits the idle status information to a mobile terminal.

The vehicle may determine an idle status when it is determined that an ignition is in an ON state based on the driving state, the vehicle is in a stopped state and a shift gear is in a P-stage.

The vehicle may determine that the operation condition of the idle notification timer is satisfied when it is determined that the occupant is not detected in the idle status.

The server may compare a first setting value of the idle notification timer received from the mobile terminal and a second setting value set in advance in the idle notification timer, generate a comparison result, and transmit the comparison result to the vehicle.

The vehicle may perform control such that the idle notification timer operates at the first setting value when the operation condition of the idle notification timer is satisfied, and the first setting value is received from the server as the comparison result.

The vehicle may perform control such that the idle notification timer operates at the second setting value when the operation condition of the idle notification timer is satisfied and a message for maintaining the second setting value is received from the server as the comparison result.

The vehicle may determine that a condition to reset a setting value of the idle notification timer is satisfied when it is determined that the occupant is detected in the idle status.

The vehicle may reset the first setting value or the second setting value to an initial setting value when it is determined that the condition to reset the setting value of the idle notification timer is satisfied.

The idle status information may include operation information of the idle notification timer and information indicating whether the occupant is detected.

According to another aspect, a vehicle include a sensor that detects a driving state and an occupant and a controller that controls an operation of an idle notification timer based on a setting value of the idle notification timer received from a server when it is determined that an operation condition of the idle notification timer is satisfied based on the driving state and whether the occupant is detected.

According to another aspect, a vehicle idle notification method includes transmitting idle status information to a server when it is determined that an operation condition of an idle notification timer is satisfied based on a driving state and whether an occupant is detected, and transmitting, by the server, the idle status information to a mobile terminal.

The vehicle idle notification method may further include determining an idle status when it is determined that an ignition is in an ON state based on the driving state, the vehicle is in a stopped state and a shift gear is in a P-stage.

The vehicle idle notification method may further include determining that the operation condition of the idle notification timer is satisfied when it is determined that the occupant is not detected in the idle status.

The vehicle idle notification method may further include receiving a first setting value of the idle notification timer from the mobile terminal to the server and transmitting, to the vehicle, a comparison result generated by comparing a second setting value set in advance in the idle notification timer with the first setting value.

The vehicle idle notification method may further include performing control such that the idle notification timer operates at the first setting value when the operation condition of the idle notification timer is satisfied, and the first setting value is received from the server as the comparison result.

The vehicle idle notification method may further include performing control such that the idle notification timer operates at the second setting value when the operation condition of the idle notification timer is satisfied and a message for maintaining the second setting value is received from the server as the comparison result.

The vehicle idle notification method may further include determining that a condition to reset a setting value of the idle notification timer is satisfied when it is determined that the occupant is detected in the idle status.

The vehicle idle notification method may further include resetting the first setting value or the second setting value to an initial setting value when it is determined that the condition to reset the setting value of the idle notification timer is satisfied.

The vehicle idle notification method may further include performing control such that the idle notification timer operates at an initial setting value when the first setting value or the second setting value is reset to the initial setting value.

The idle status information may include operation information of the idle notification timer and information indicating whether the occupant is detected.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
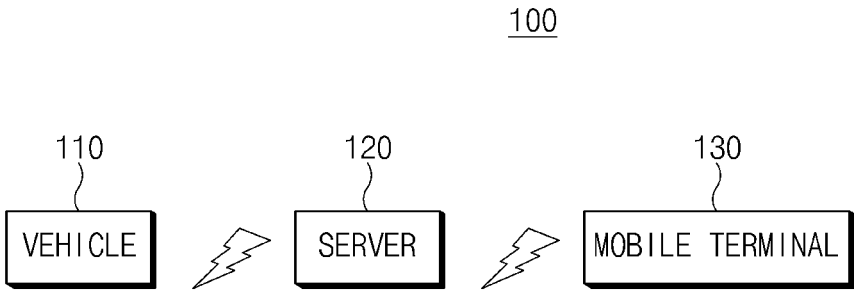
FIG. 1 is a diagram illustrating a configuration of a vehicle idle notification system according to an embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, some embodiments of the present disclosure will be described in detail with reference to the exemplary drawings In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the constituent components. Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

FIG. 1 is a diagram illustrating a configuration of a vehicle idle notification system according to an embodiment of the present disclosure.

As illustrated in FIG. 1, an idle notification system 100 for a vehicle according to an embodiment of the present disclosure may include a vehicle 110, a server 120, and a mobile terminal 130.

The vehicle 110 may determine whether the vehicle 110 is in an idle status based on whether the vehicle 110 is in a driving state, determine whether an operation condition of an idle notification timer is satisfied based on whether an occupant is detected in the vehicle 110, and when the operation condition of the idle notification timer is satisfied, transmit an idle notification to the mobile terminal 130.

Here, when an ignition is in an ON state, the vehicle 110 is in a stopped state, and a shift gear is in a P-stage, the vehicle 110 may be determined to be in an engine idle status. In addition, when the vehicle 110 is in the idle status and it is determined that the occupant of the vehicle 110 is not detected, the vehicle 110 may determine that the operation condition of the idle notification timer is satisfied.

When the operation condition of the idle notification timer is satisfied and the vehicle 110 receives a first setting value from the server 120, the vehicle 110 may allow the idle notification timer to operate at the first setting value. Here, the first setting value may mean a setting value of the idle notification timer input from the mobile terminal 130.

When the operation condition of the idle notification timer is satisfied and the vehicle 110 receives a message for maintaining a second setting value from the server 120, the vehicle 110 may allow the idle notification timer to operate at the second setting value. Here, the second setting value may mean a setting value of the idle notification timer which is preset in the vehicle 110.

When the vehicle 110 determines that the vehicle 110 is in the idle status or the occupant is detected, the vehicle 110 may determine that a condition to reset a setting value of the idle notification timer is satisfied, and when it is determined that the condition to reset the setting value of the idle notification timer is satisfied, the vehicle 110 may reset the first setting value or the second setting value to an initial setting value. Here, the initial setting value may mean a setting value set to the idle notification timer when the vehicle 110 is released.

When the vehicle 110 receives a start-OFF message from the server 120, the vehicle 110 may perform control to turn off a start operation. When the start operation is turned off, a start-OFF confirmation message may be transmitted to the server 120.

The server 120 may compare the first setting value received from the mobile terminal 130 with the second setting value of the idle notification timer stored in advance in the vehicle 110. The server 120 may transmit the first setting value to the vehicle 110 when the first setting value is different from the second setting value. On the other hand, when the first setting value is not different from the second setting value, the server 120 may transmit a message for enabling the idle notification timer to maintain the second setting value to the vehicle 110.

When the server 120 receives the start-OFF message from the mobile terminal 130, the server 120 may transmit the start-OFF message to the vehicle 110. When the server 120 receives the start-OFF confirmation message from the vehicle 110, the server 120 may transmit the start-OFF message to the mobile terminal 130.

The mobile terminal 130 may refer to a mobile terminal of a user who has a history of using the vehicle 110, and the user may input a setting value of an idle notification timer of the vehicle 110 through an input device of the mobile terminal 130. According to an embodiment of the present disclosure, the mobile terminal 130 may output an input signal for setting the setting value of the idle notification timer of the vehicle as the first setting value according to a manipulation, an operation, or a speech corresponding to a user's request. When the idle notification message is received from the server 120, the vehicle 110 may inform the user that the vehicle 110 is in an idle status by outputting the idle notification message. The mobile terminal 130 may output an input signal corresponding to a message for requesting the vehicle 110 to turn off a start operation to the server 120 according to a manipulation, an operation, or a speech corresponding to the user's request, and transmit the start-OFF message to the server 120. In addition, when the vehicle start-OFF confirmation message is received from the server 120, the status information indicating that the start operation of the vehicle 110 is turned off may be output to guide the user.

Therefore, the vehicle idle notification system according to an embodiment of the present disclosure may set a setting value for idle notification based on the input information requested by the user and transmit the idle status information to the mobile terminal 130 to the user. The idle status of the vehicle 110 may be guided to stop the idle status of the vehicle.

Hereinafter, each component of the vehicle idle notification system will be described in detail to describe the vehicle idle notification system according to an embodiment of the present disclosure in detail.

Figure 2:
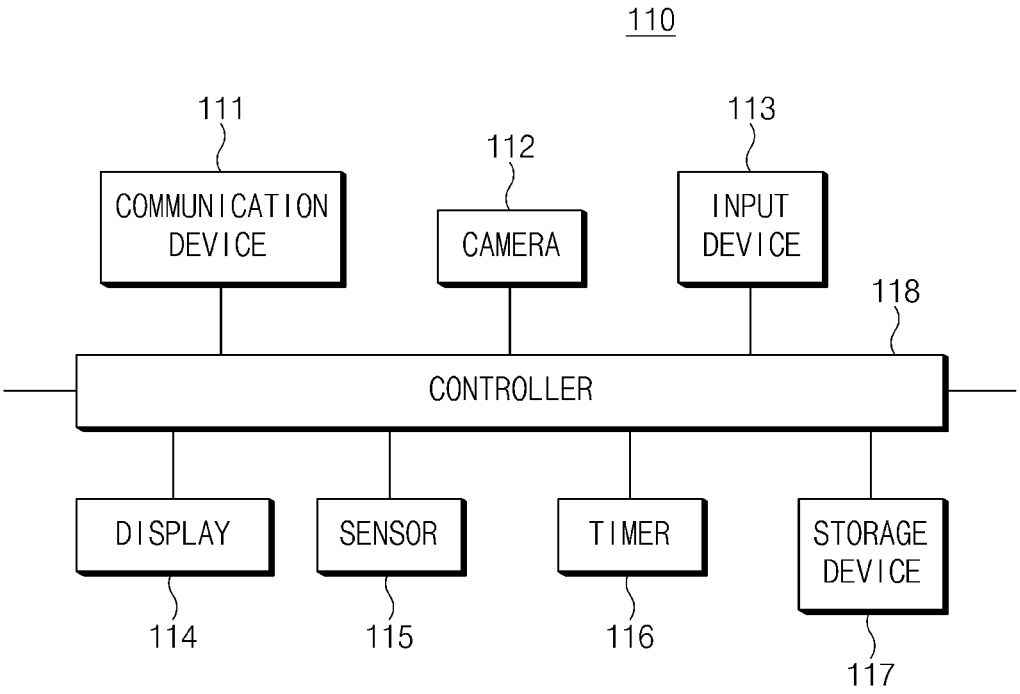
FIG. 2 is a diagram illustrating a configuration of a vehicle according to an embodiment of the present disclosure.

FIG. 2 is a diagram illustrating a configuration of a vehicle according to an embodiment of the present disclosure.

As illustrated in FIG. 2, the vehicle 110 according to the present disclosure may include a communication device 111, a camera 112, an input device 113, a display 114, a sensor 115, a timer 116, a storage device 117 and a controller 118.

The communication device 111 may be connected to the server 120 in a wired or wireless manner to transmit idle status information to the server 120. When connected by wire, the communication device 111 may be connected to the server 120 by a USB cable, and when connected by wireless, the communication device 111 may be connected to the server 120 by Wi-Fi direct communication. According to an embodiment, connection may be performed through via short-range wireless communication, such as wireless broadband, Wimax (World Interoperability for Microwave Access), Bluetooth, Radio Frequency Identification (RFID), Infrared Data Association (IrDA), Ultra Wideband (UWB), Zigbee, or the like. According to an embodiment of the present disclosure, the communication device 111 may be implemented by an AVNT (AUDIO VIDEO NAVIGATION TELEMATICS) device.

The camera 112 may be provided inside the vehicle 110 to obtain an occupant image by capturing an occupant, and the controller 118 may determine whether the occupant is detected based on the image obtained by the camera 112. According to an embodiment of the present disclosure, the camera 112 may include a Charge-Coupled Device (CCD) camera or a CMOS color image sensor. In this case, the CCD and the CMOS may refer to a sensor that converts light incident on the lens of the camera into an electrical signal and store the electrical signal. In the disclosed disclosure, the camera 112 may be any device as long as the device is able to obtain an image, and there is no limitation.

The input device 113 may output an input signal corresponding to the manipulation, operation, or speech of an occupant, and the controller 118 may determine whether the occupant is detected based on the input signal.

The input device 113 may be implemented using a scroll wheel, a button, a knob, a touch screen, a touch pad, a lever, a track ball, or the like which can be manipulated by the occupant, or may be implemented using at least one or a combination of a motion sensor that detects motion of the occupant and a speech recognition sensor that detects speech of the occupant. For example, the input device 113 may include a room mirror operation device, an air conditioning operation device, an AUTO HOLD operation device, a DRIVING MODE operation device, a handle heating operation device, a ventilation and heating sheet operation unit, a door opening/locking operation device, a window opening and closing operation device, a handle call and volume control device, a rear seat ventilation and heating line operation device, or the like. However, the present disclosure is not limited thereto, and may further include an operation device for controlling operations of devices inside and outside the vehicle 110.

The display 114 may be implemented using an Audio Video Navigation Telematics (AVNT) device and may display an image corresponding to a control signal of the controller 118. The display 114 may be implemented using a display device employing a liquid crystal display (LCD) panel, a light emitting diode (LED) panel, an organic light emitting diode (OLED) panel, or a plasma display panel (PDP). The liquid crystal display may include a thin film transistor liquid crystal display (TFT-LCD). According to an embodiment of the present disclosure, the display 114 may be implemented integrally with the input device 113 by a touch screen panel (TSP).

The sensor 115 may obtain driving information and occupant detection information of the vehicle 110. According to an embodiment of the present disclosure, the sensor 115 may include a sensor for detecting ignition ON/OFF of the vehicle 110, a sensor for detecting whether the vehicle 110 is stopped, a sensor for detecting a shift gear, and a sensor for detecting an input signal of the input device 113, a speed sensor installed inside a wheel of the vehicle 110 to detect a rotational speed of a vehicle wheel and measure a vehicle speed value, an accelerator pedal sensor for detecting a degree of pressurization of the accelerator pedal, a brake pedal sensor for detecting a degree of pressurization of a brake pedal, a belt sensor for detecting whether a seat belt is fastened, a radar for detecting an occupant in the vehicle 110, or the like. The controller 118 may determine whether the occupant is detected based on occupant detection information obtained by the sensor 115.

The timer 116 may refer to an idle notification timer of the vehicle 110 and operate when the controller 118 determines that an operation condition of the timer 116 is satisfied, and when the number of notification transmissions up to now does not exceed the maximum number of notification transmissions.

According to an embodiment of the present disclosure, a notification interval and a maximum number of notification transmissions may be set in the timer 116 based on information input from the mobile terminal 130 in the timer 116, and the timer 116 may be operate based on a first setting value when a value (first setting value) set based on the information input from the mobile terminal 130 is stored in the storage device 117.

In addition, according to another embodiment of the present disclosure, the notification interval and the maximum number of notification transmissions may be set in the timer 116 based on information preset in the vehicle 110. When a preset value (second setting value) is maintained as it is and stored in the storage device 117, the timer 116 may operate based on the second setting value.

In addition, even if the timer 116 operates based on the first setting value or the second setting value, when the controller 118 determines that the reset condition of the timer setting value is satisfied, the timer 116 may adjust the first setting value or the second setting value to the initial setting value. Here, the initial setting value may mean a setting value set to the idle notification timer when the vehicle 110 is released.

The storage device 117 may store an algorithm or a program for operation or execution of various commands of the controller 118 and may store a setting value of the timer for notifying idle (the first setting value, the second setting value or the initial setting value).

The controller 118 may be implemented by various processing devices such as a microprocessor incorporating a semiconductor chip or the like capable of operation or execution of various commands and may control an idle notification operation of a vehicle according to an embodiment of the present disclosure.

In detail, the controller 118 may perform control to transmit a setting value (second setting value) of the timer 116, which is set in the vehicle 110 in advance, to the server 120.

The controller 118 may determine whether an operation condition of the timer 116 is satisfied. More specifically, the controller 118 may determine whether an operation condition of the timer 116 is satisfied based on driving information and occupant detection information obtained from the sensor 115. The occupant detection information may include information indicating whether an occupant is detected by the camera/radar, information indicating whether a signal is output from the input device by the occupant, information indicating whether an accelerator or brake pedal is pressed by the occupant, and information indicating whether a seat belt is fastened. When the camera or the radar is provided in the vehicle 110, the controller 118 may determine whether the occupant is detected by using the camera or the radar. When the camera or the radar is not provided in the vehicle 110, the controller 118 may determine whether the occupant is detected based on whether a signal is output from the input device 113, whether the accelerator or brake pedal is pressed, or whether the seat belt is fastened. The controller 118 may determine that the occupant is detected when at least one piece of the occupant detection information is obtained and may determine that the occupant is not detected when all the occupant detection information is not present.

The controller 118 may determine whether the vehicle 110 is in an idle status based on whether the ignition is in an ON/OFF state, whether the vehicle 110 is stopped, or whether the shift gear is in the P-stage. The controller 118 may determine a status in which the ignition is in the ON state, the vehicle 110 is in a stopped state, and the shift gear is in a P-stage as an idle status. When the vehicle 110 is in the idle status, but the occupant is not detected, the controller 118 may determine that the operation condition of the timer 116 is satisfied, When the operation condition of the timer 116 is satisfied and the vehicle 110 receives the first setting value, received from the mobile terminal 130, from the server 120, the controller 118 may perform control such that the timer 116 operates at the first setting value. In addition, the controller 118 may perform control such that the timer 116 operates at the second setting value when the operation condition of the timer 116 is satisfied and the vehicle 110 receives a message for maintaining the second setting value from the server 120.

When the controller 118 determines that the setting value reset condition of the timer 116 is satisfied while the timer 116 is operating at the first setting value or the second setting value, the controller 118 may perform control to reset the first setting value or the second setting value of the timer 116 to an initial setting value. Here, the controller 118 may determine whether the setting value reset condition of the timer 116 is satisfied according to whether the occupant is detected. That is, when it is determined that the occupant is detected in the vehicle 110, the vehicle 110 may determine that the setting value reset condition of the timer 116 is satisfied. When it is determined that no occupant is detected in the vehicle 110, the controller 118 may determine that the setting value reset condition of the timer 116 is not satisfied.

A more detailed description relating to a method of detecting the occupant will be made with reference to FIG. 8.

The controller 118 may perform control to transmit idle status information to the server 120 when a notification interval time (timer operation time) included in at least one of the first setting value, the second setting value, or the initial setting value has elapsed. Here, the idle status information may include the vehicle's position information, the vehicle's driving information, the vehicle's driving distance, operation information of an idle notification timer (the number of idle notification transmissions up to now, the maximum number of notification transmissions, the idle detection time, the notification interval time of the idle notification timer, or the like), whether an occupant is detected, or the like.

The controller 118 may perform control to turn off the start operation of the vehicle 110 when receiving the start-OFF message from the server 120. In addition, the controller 118 may perform control to transmit a vehicle start-OFF confirmation message to the server 120.

Figure 3:
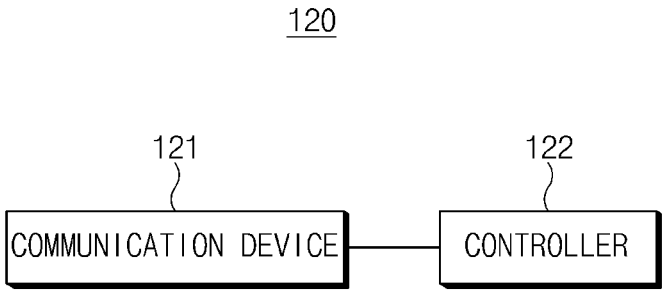
FIG. 3 is a diagram illustrating a configuration of a server according to an embodiment of the present disclosure.

FIG. 3 is a diagram illustrating a configuration of a server according to an embodiment of the present disclosure.

As illustrated in FIG. 3, the server 120 according to an embodiment of the present disclosure may include a communication device 121 and a controller 122.

The communication device 121 may be connected to the mobile terminal 130 in a wired or wireless manner to receive a timer setting value (first setting value) input to the mobile terminal 130, and may be connected to the vehicle 110 in a wired or wireless manner to receive a setting value (second setting value) of the timer 116 set in advance in the vehicle 110. The communication device 121 may receive vehicle idle status information from the vehicle 110 and may transmit the vehicle idle status information to the mobile terminal 130. In addition, the communication device 121 may receive a start-OFF message from the mobile terminal 130 and transmit the start-OFF message to the vehicle 110. In addition, the communication device 121 may receive a start-OFF confirmation message from the vehicle 110 and transmit the start-OFF confirmation message to the mobile terminal 130.

The communication device 121 may be connected by a USB cable when connected by wire or may be connected by Wi-Fi direct communication when connected wirelessly. According to an embodiment, connection may be performed through via short-range wireless communication, such as wireless broadband, Wimax (World Interoperability for Microwave Access), Bluetooth, Radio Frequency Identification (RFID), Infrared Data Association (IrDA), Ultra Wideband (UWB), Zigbee, or the like.

The controller 122 may be implemented by various processing devices such as a microprocessor incorporating a semiconductor chip or the like capable of operation or execution of various commands and may control the overall operation of the server 120 according to an embodiment of the present disclosure.

The controller 122 may compare the first setting value received from the mobile terminal 130 and the second setting value received from the vehicle 110 and determine whether the setting values are different from each other. When the controller 122 determines that the first setting value and the second setting value are different from each other, the controller 122 may perform control to transmit the first setting value to the vehicle 110. Meanwhile, when the first setting value and the second setting value are identical to each other, the controller 122 may perform control to transmit a message for maintaining the second setting value to the vehicle 110.

Figure 4:
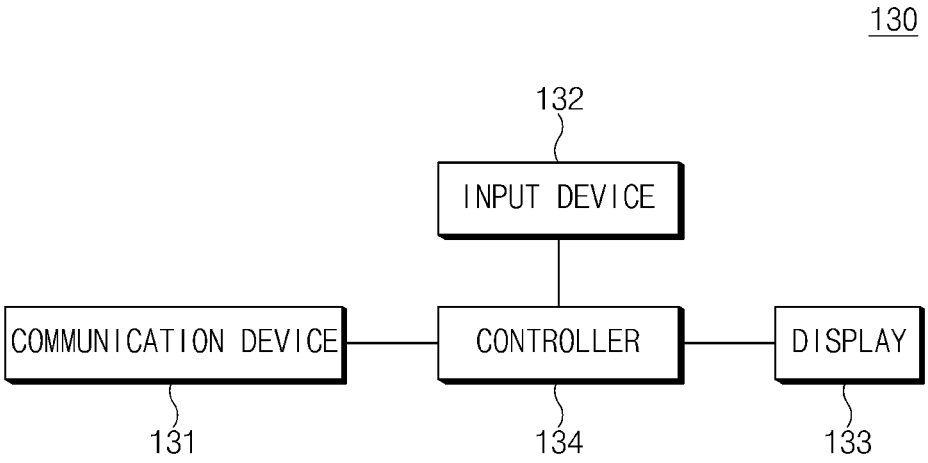
FIG. 4 is a diagram illustrating a configuration of a mobile terminal according to an embodiment of the present disclosure.

FIG. 4 is a diagram illustrating a configuration of a mobile terminal according to an embodiment of the present disclosure.

As illustrated in FIG. 4, the mobile terminal 130 according to an embodiment of the present disclosure may include a communication device 131, an input device 132, a display 133, and a controller 134.

The communication device 131 may be connected to the server 120 to transmit a timer setting value (first setting value) input to the input device 132 to the server 120. The communication device 131 may be connected by a USB cable when connected by wire or may be connected by Wi-Fi direct communication when connected wirelessly. According to an embodiment, connection may be performed through via short-range wireless communication, such as wireless broadband, Wimax (World Interoperability for Microwave Access), Bluetooth, Radio Frequency Identification (RFID), Infrared Data Association (IrDA), Ultra Wideband (UWB), Zigbee, or the like.

The input device 132 may output an input signal corresponding to the first setting value according to a user's manipulation, operation, or speech, and the controller 134 may determine the first setting value based on the input signal. In addition, the input device 132 may output an input signal corresponding to a message for requesting the vehicle 110 to turn off a start operation according to a user's manipulation, operation, or speech, and the controller 134 may perform control to transmit the input signal, which is output from the input device 132, to the server 120. The input device 113 may be implemented using a button, a touch screen, a touch pad, or the like which can be manipulated by a user, or may be implemented using at least one or a combination of a motion sensor that detects motion of the user and a speech recognition sensor that detects speech of the occupant.

The display 133 may display an image corresponding to a control signal of the controller 134. For example, the display 133 may output idle status information received from the server 120 and may receive a vehicle start-OFF confirmation message and output vehicle start-OFF status information.

The controller 122 may be implemented by various processing devices such as a microprocessor incorporating a semiconductor chip or the like capable of operation or execution of various commands and may control the overall operation of the mobile terminal 130 according to an embodiment of the present disclosure.

The controller 134 may determine the first setting value based on the input signal output from the input device 132. When the idle status information is received from the server 120, the controller 134 may perform control to output the idle status information through the display 133, and perform control to transmit an input signal corresponding to a message requesting the vehicle 110 to turn off a start operation of the vehicle 110, which is output from the input device 132, to the server 120. In addition, when the controller 134 receives the vehicle start-OFF confirmation message from the server 120, the controller 134 may perform control to output the vehicle start-OFF status information through the display 133.

Figure 5:
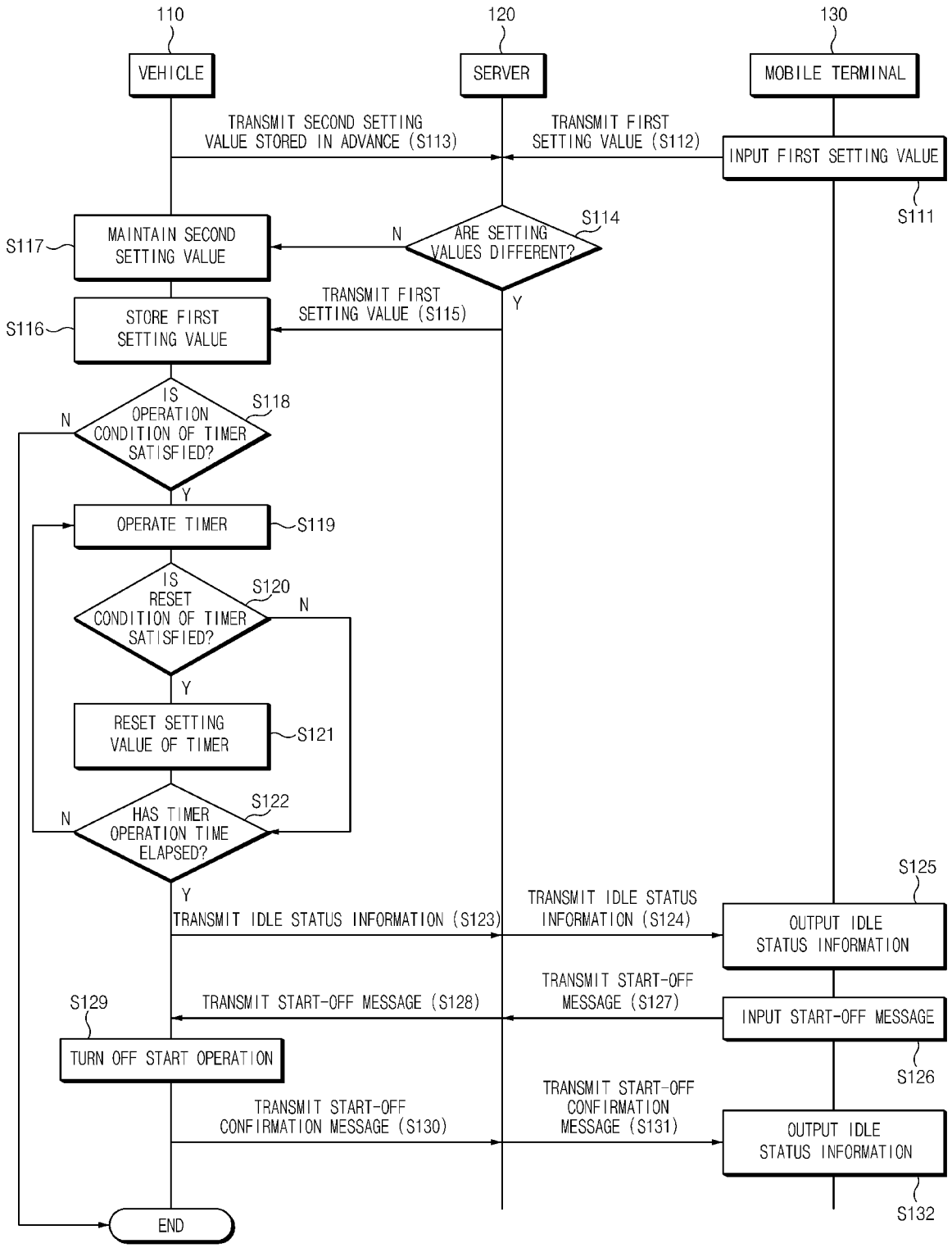
FIG. 5 is a diagram illustrating a flowchart of an operation of a vehicle idle notification system according to an embodiment of the present disclosure.

FIG. 5 is a diagram illustrating a flowchart of an operation of a vehicle idle notification system according to an embodiment of the present disclosure.

As illustrated in FIG. 5, the mobile terminal 130 may input a first setting value of the timer 116 (S111) and transmit the first setting value to the server 120 (S112). The vehicle 110 may transmit the first setting value of the timer 116 stored in advance in the storage device 117 to the server 120 (S113).

The server 120 may compare the first setting value and the second setting value and determine whether they are different from each other (S114). When the server 120 determines that the setting values are different from each other (Y), the server 120 may transmit the first setting value to the vehicle 110 (S115). When the server 120 determines that the setting values are not different from each other (N), the server 120 may transmit a message for maintaining the second setting value.

When the vehicle 110 receives the first setting value from the server 120, the vehicle 110 may store a setting value of the timer 116 as the first setting value (S116) and when receiving the message for maintaining the second setting value from the server 120, the vehicle 110 may maintain the setting value of the timer 116 as the second setting value (S117).

The vehicle 110 may determine whether an operation condition of the timer is satisfied based on the driving information and the occupant detection information obtained from the sensor 115 (S118). A more detailed description for S118 will be given with reference to FIGS. 7 and 8.

When the vehicle 110 determines in S118 that the operation condition of the timer is satisfied (Y), the vehicle 110 may perform control to operate the timer (S119). When the vehicle 110 determines that the operation condition of the timer 116 is not satisfied (N) in S118, the vehicle 110 may finish the idle notification operation of the vehicle 110. When the operation condition of the timer 116 is satisfied and the vehicle 110 receives the first setting value from the server 120, which is received from the mobile terminal 130, in S119, the vehicle 110 may perform control such that the timer 116 operates at the first setting value. In addition, the vehicle 110 may perform control such that the timer 116 operates at the second setting value when the operation condition of the timer 116 is satisfied and the vehicle 110 receives a message for maintaining the second setting value from the server 120.

The vehicle 110 may determine whether a setting value reset condition of the timer 116 is satisfied based on the driving information and the occupant detection information obtained from the sensor 115 during the operation of the timer 116 (S120). In S120, the vehicle 110 may determine whether the setting value reset condition of the timer 116 is satisfied according to whether the occupant is detected. That is, when it is determined that the occupant is detected in the vehicle 110, the vehicle 110 may determine that the setting value reset condition of the timer 116 is satisfied. When it is determined that no occupant is detected in the vehicle 110, the vehicle 110 may determine that the setting value reset condition of the timer 116 is not satisfied.

When it is determined in S120 that the setting value reset condition of the timer 116 is satisfied (Y), the first setting value of the timer 116 stored in S116 or the second setting value maintained in S117 is reset to an initial setting value (S121). On the other hand, when the vehicle 110 determines that the setting value reset condition of the timer 116 is not satisfied (N) in S120, the vehicle 110 may perform S122.

The vehicle 110 may determine whether a notification interval time included in at least one of the first setting value, the second setting value, or the initial setting value has elapsed (S122). Specifically, when the vehicle 110 determines that the setting value reset condition of the timer 116 is satisfied in S120, the vehicle 110 may determine whether or not the notification interval time included in the initial setting value has elapsed in S122. When the vehicle 110 determines that the setting value reset condition of the timer 116 is not satisfied in S120, the vehicle 110 may determine whether the notification interval time included in the first setting value or the second setting value has elapsed in S122.

When it is determined in S122 that the notification interval time has elapsed (Y), the vehicle 110 may transmit idle status information to the server 120 (S123). When it is determined in S122 that the notification interval time has not elapsed (N), the vehicle 110 may perform S119.

The idle status information transmitted by the vehicle 110 in S123 may include the vehicle's position information, the vehicle's driving information, the vehicle's driving distance, the number of idle notification transmissions up to now, the maximum number of notification transmissions, the idle detection time, the idle notification interval time, whether an occupant is detected, or the like.

The server 120 may transmit the idle status information received from the vehicle 110 to the mobile terminal 130 (S124). The mobile terminal 130 may output idle status information received from the server 120 (S125).

When the mobile terminal 130 receives the idle status information from the server 120, the mobile terminal 130 may input a message for requesting the vehicle 110 to turn off a start operation according to input of the user's manipulation, operation, or speech (S126), and may transmit a start-OFF message related to the vehicle 110 to the server 120 (S127).

The server 120 may transmit the start-OFF message received from the mobile terminal 130 to the vehicle 110 (S128), and the vehicle 110 may perform control to turn off the start operation based on the start-OFF message received from the server 120 (S129). When the vehicle 110 turns off the start operation, the vehicle 110 may transmit a start-OFF confirmation message to the server 120 (S130), and the server 120 may transmit the start-OFF confirmation message received from the vehicle 110 to the mobile terminal 130 (S131). When the mobile terminal 130 receives the start-OFF confirmation message from the server 120, the mobile terminal 130 may perform control to output the start-OFF status information of the vehicle (S132).

Figure 6:
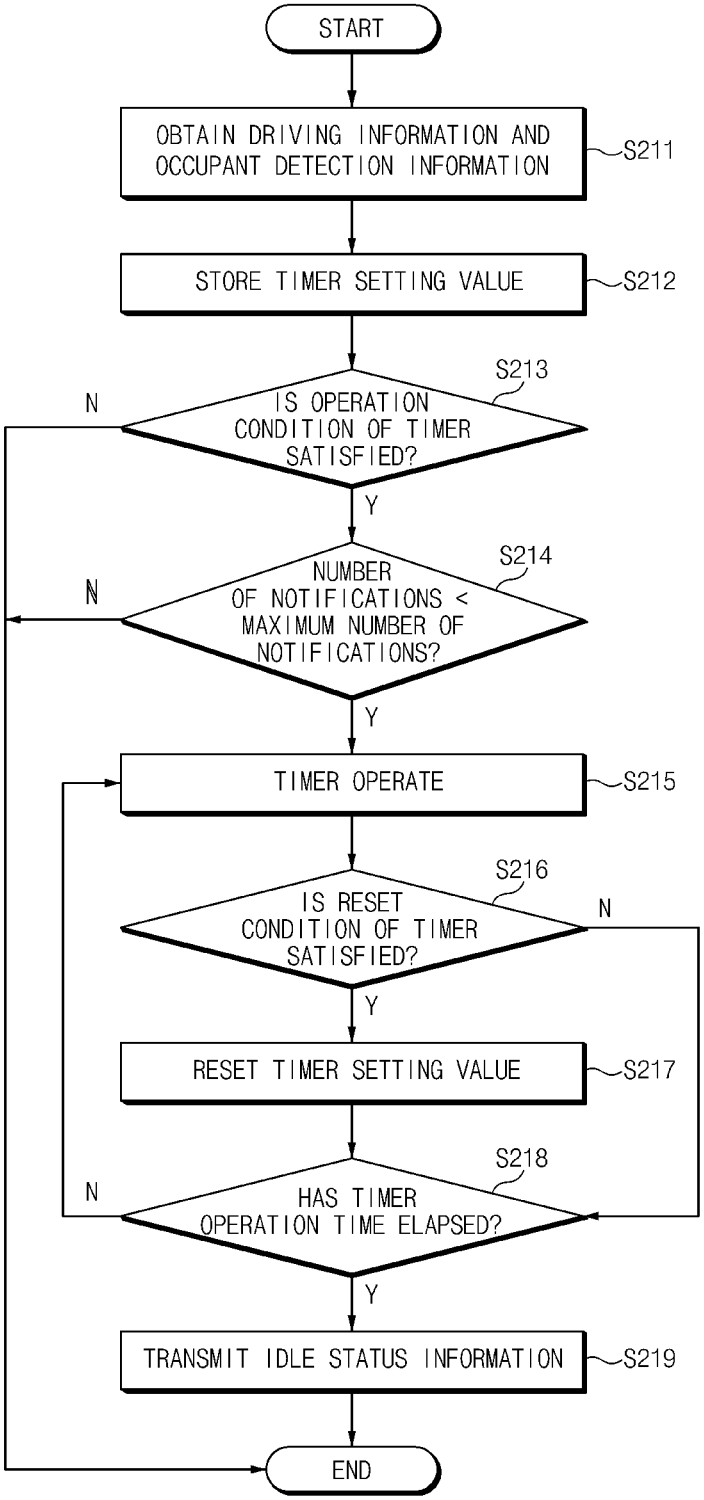
FIG. 6 is a diagram illustrating a flowchart of an idle notification operation of a vehicle according to an embodiment of the present disclosure.

FIG. 6 is a diagram illustrating a flowchart of an idle notification operation of a vehicle according to an embodiment of the present disclosure.

As illustrated in FIG. 6, the controller 118 may obtain driving information and occupant detection information from the sensor 115 (S211).

The controller 118 may store a timer setting value (S212). In S212, when the controller 118 receives the first setting value from the server 120, the controller 118 may store the setting value of the timer 116 as the first setting value (S116). When receiving a message for maintaining the second setting value from the server, the controller 118 may maintain the setting value of the timer 116 as the second setting value.

The controller 118 may determine whether an operation condition of the timer is satisfied based on the driving information and the occupant detection information obtained from the sensor 115 (S213). A more detailed description for S213 will be made with reference to FIGS. 7 and 8. When it is determined that the operation condition of the timer is satisfied (Y), the controller 118 may determine whether the number of idle notification transmissions up to now is less than the maximum number of notification transmissions (S214). The number of idle notification transmissions up to now in S214 may refer to the number of transmissions of idle status information up to now, and the maximum number of notification transmissions may refer to the number of times capable of transmitting an idle status.

The controller 118 may control the timer 116 to operate when it is determined that the number of idle notification transmissions up to now is less than the maximum number of notification transmissions (for example, in the case of the second transmission of three that is the maximum number of transmissions). When the controller 118 stores the first setting value in S212, the controller 118 may control the timer 116 to operate at the first setting value in S215. In addition, when the controller 118 maintains the second setting value in S212, the controller 118 may control the timer 116 to operate at the second setting value in S215.

The controller 118 may determine whether a setting value reset condition of the timer 116 is satisfied based on the driving information and the occupant detection information obtained from the sensor 115 while the timer 116 operates at the first setting value or the second setting value (S216). A detailed description of S216 will be made with reference to FIG. 7.

When it is determined in S216 that the setting value reset condition of the timer 116 is satisfied (Y), the controller 118 may perform control to reset the first setting value or the second setting value of the timer 116 to an initial setting value (S217). On the other hand, when the controller 118 determines that the setting value reset condition of the timer 116 is not satisfied in S216 (N), the controller 118 may perform S218.

The controller 118 may determine whether a notification interval time included in at least one of the first setting value, the second setting value, or the initial setting value has elapsed (S218). Specifically, when the vehicle 110 determines that the setting value reset condition of the timer 116 is satisfied in S216, the vehicle 110 may determine whether or not the notification interval time included in the initial setting value has elapsed in S122. When the vehicle 110 determines that the setting value reset condition of the timer 116 is not satisfied in S216, the vehicle 110 may determine whether the notification interval time included in the first setting value or the second setting value has elapsed in S218.

When it is determined in S218 that the notification interval time has elapsed (Y), the controller 118 may transmit idle status information to the server 120 (S219). On the other hand, when it is determined in S218 that the notification interval time has not elapsed (N), the controller 118 may perform S215.

The idle status information transmitted in S219 may include the vehicle's position information, the vehicle's driving status information, the vehicle's driving distance, the number of idle notification transmissions up to now, the maximum number of notification transmissions, the idle detection time, the idle notification interval time, whether an occupant is detected, or the like.

Figure 7:
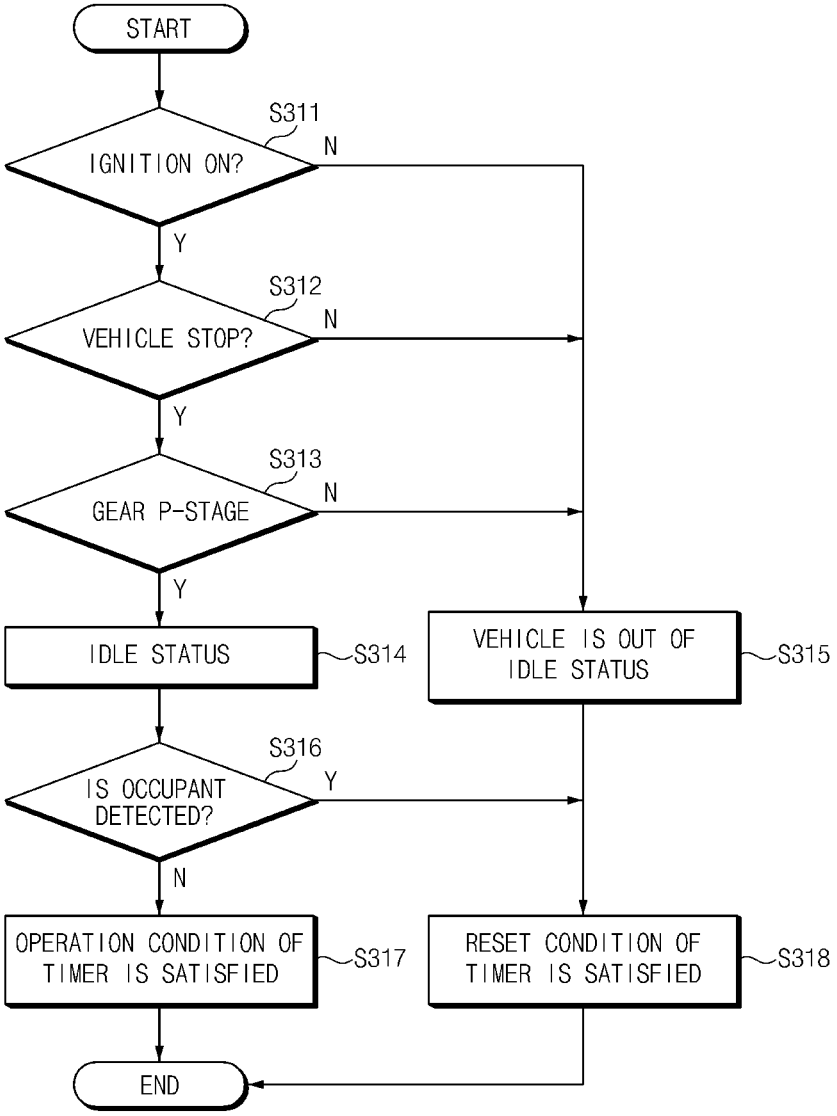
FIG. 7 is a diagram illustrating a flowchart of an idle notification operation of a vehicle according to another embodiment of the present disclosure.

FIG. 7 is a diagram illustrating a flowchart of an idle operation of a vehicle according to another embodiment of the present disclosure.

As illustrated in FIG. 7, the controller 118 may determine whether the ignition is in an ON state based on driving information obtained from the sensor 115 (S311). When it is determined that the ignition is in the ON state (Y), the controller 118 determines whether the vehicle is in a stopped state (S312). When it is determined that the vehicle 110 is in the stopped state (Y), the controller 118 may determine whether a shift gear is in a P-stage (S313). When it is determined that the shift gear is in the P-stage (Y), the controller 118 may determine that the vehicle is in an idle status (S314).

On the other hand, when the controller 118 determines that the ignition is not in the ON state based on driving information obtained from the sensor 115 in S311 (N), the controller 118 determines that the vehicle 110 is not in the stopped state (N) in S312, or the controller 118 determines that that the shift gear is not in the P-stage (N) in S313, the controller may determine that the vehicle 110 is out of the idle status (S315).

In addition, the controller 118 may determine whether an occupant is detected based on the occupant detection information obtained from the sensor 115 (S316). A more detailed description of S316 will be made with reference to FIG. 8. When it is determined that the occupant is not detected in S316 (N), the controller 118 may determine that the operation condition of the timer 116 is satisfied (S317).

On the other hand, the controller 118 determines that the vehicle 110 is out of the idle status in S311, S312 or S313 (S315), or when the controller 118 determines that the occupant is detected in S316 (Y), the controller 118 may determine that the reset condition of the timer 116 is satisfied. (S318).

Figure 8:
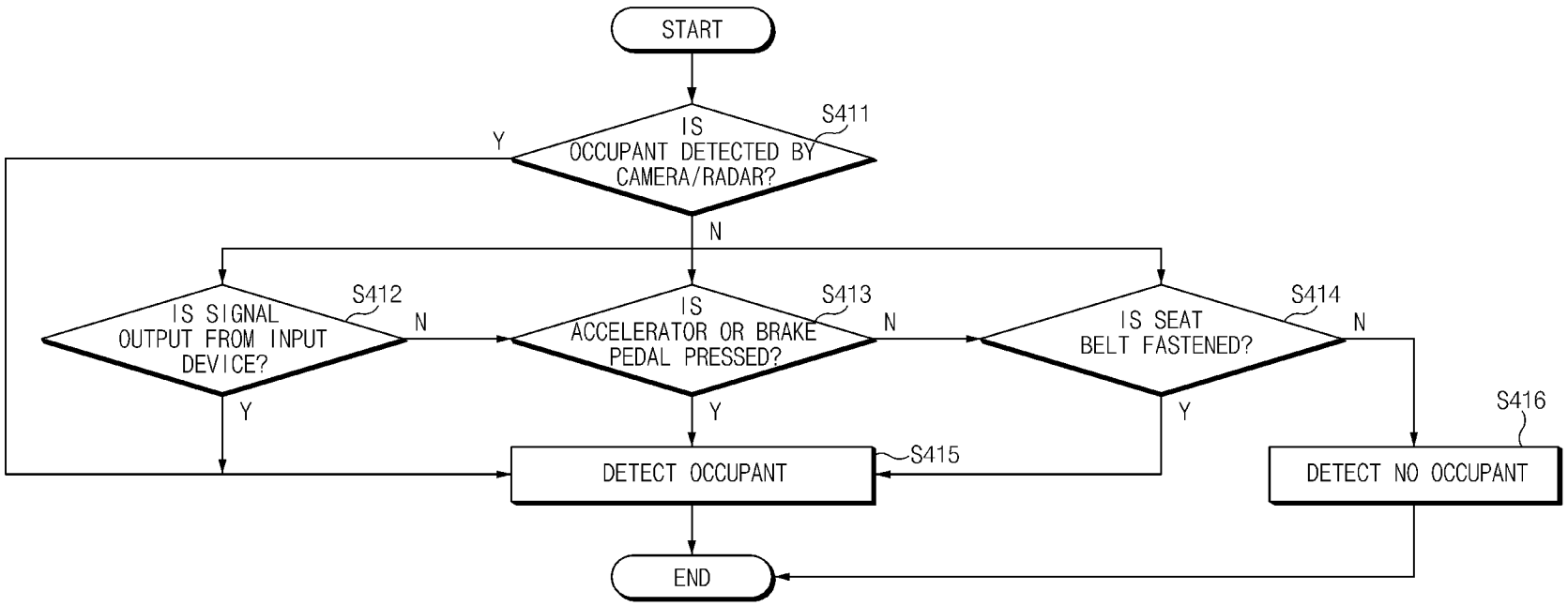
FIG. 8 is a diagram illustrating a flowchart of an occupant detecting method according to an embodiment of the present disclosure.

FIG. 8 is a diagram illustrating a flowchart of an occupant detecting method according to an embodiment of the present disclosure.

FIG. 8 illustrates an occupant detecting method when the camera 112 or the radar sensor 115 is provided according to an embodiment of the present disclosure, and the controller 118 may determine whether an occupant is detected based on occupant detection information obtained from the camera 112 or the radar sensor 115 (S411). When the controller 118 determines that no occupant is detected in S411 (N), the controller 118 may determine whether an input signal is output from the input device 113 (S412), determine whether an accelerator or brake pedal is pressed (S413), or determine whether a seat belt is fastened (S414). When the controller 118 determines that the input signal is not output from the input device 113 in S412, the controller 118 determines that an accelerator or brake pedal is not pressed in S413, and the controller 118 determines that the seat belt is not fastened (N) in S414, the controller 118 may determine that no occupant is detected (S416).

On the other hand, when it is determined that the occupant is detected by the camera 112 or the radar sensor 115 (Y) in S411, that the input signal is output from the input device 113 (Y) in S412, that the accelerator or brake pedal is pressed (Y) in S413 or that the seat belt is fastened in S414, the controller 118 may determine that the occupant is detected (S415).

Figure 9:
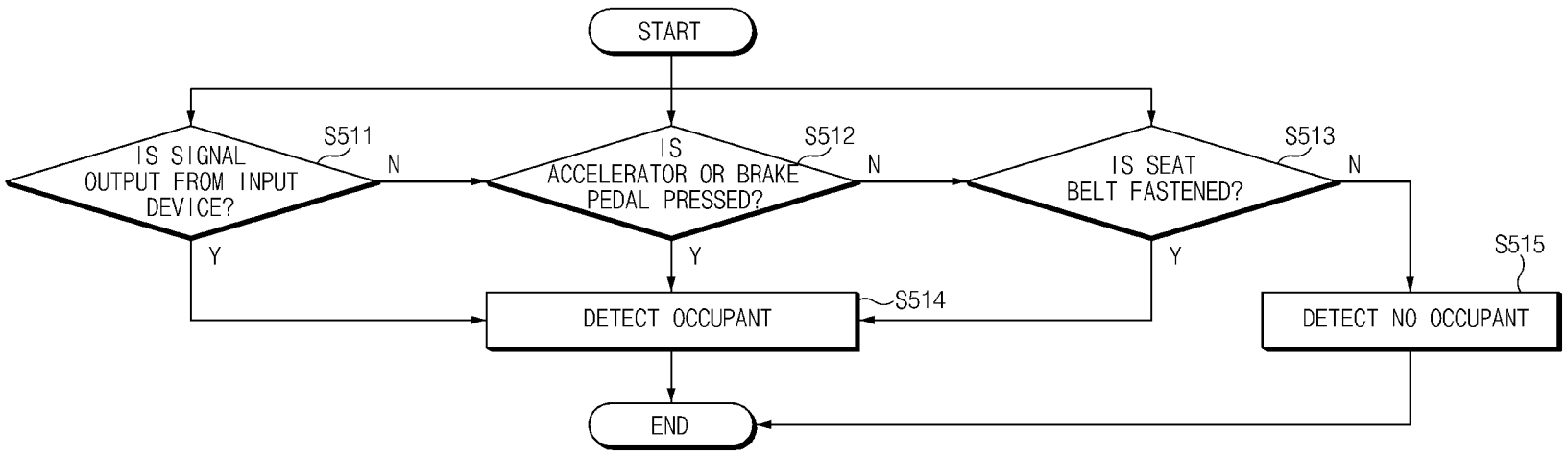
FIG. 9 is a diagram illustrating a flowchart of an occupant detecting method according to another embodiment of the present disclosure.

FIG. 9 is a diagram illustrating a flowchart of an occupant detecting method according to another embodiment of the present disclosure.

FIG. 9 illustrates an occupant detecting method when the camera 112 or the radar sensor 115 is not provided in the vehicle 110 according to an embodiment of the present disclosure. The controller 118 may determine whether an input signal is output from the input device 113 (S511), determine whether an accelerator or brake pedal is pressed (S512), or determine whether a seat belt is fastened (S513). The controller 118 may determine that no occupant is detected (S515), when the controller 118 determines that a signal is not output from an input device (N), the controller 118 determines that the accelerator or brake pedal is not pressed (N) in S512, and the controller 118 determines that the belt is not fastened (N) in S513.

On the other hand, the controller 118 may determine that the occupant is detected when it is determined that the input signal is output from the input device 113 (Y) in S511, that the accelerator or brake pedal is pressed (Y) in S512, or that the occupant is detected in S513 (S514).

Figure 10:
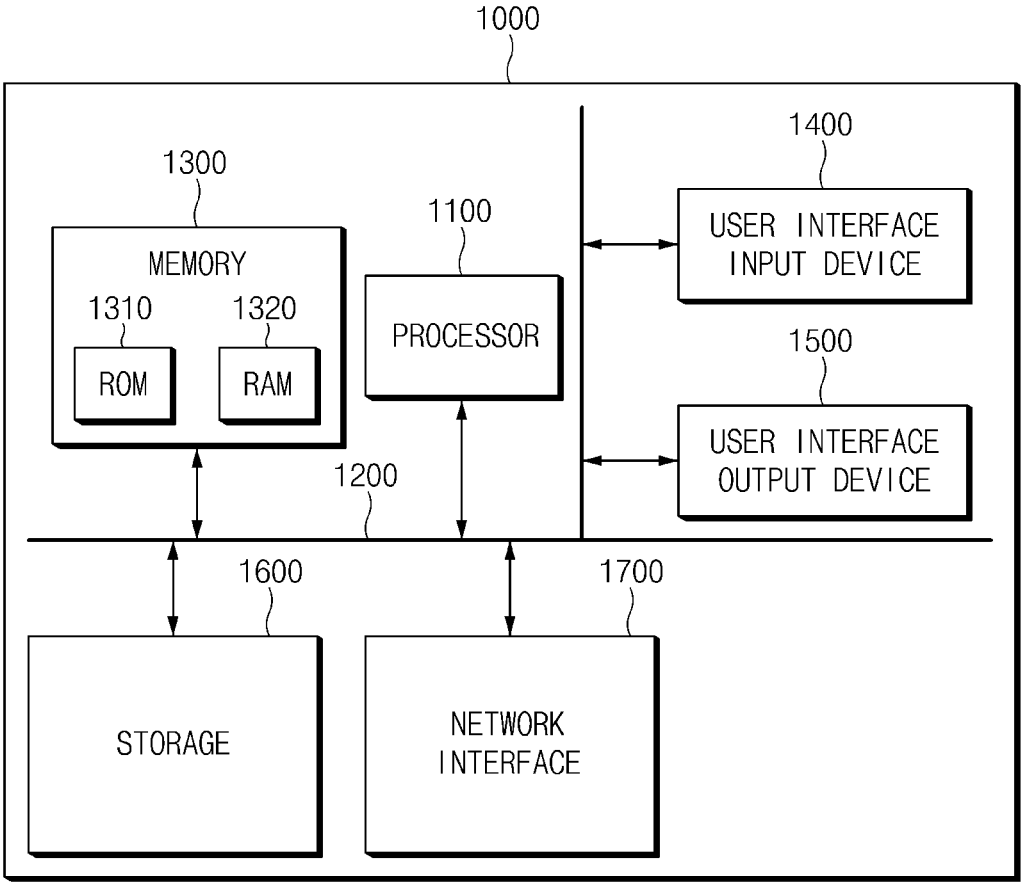
FIG. 10 is a diagram illustrating a configuration of a computing system for executing a method according to an embodiment of the present disclosure.

FIG. 10 is a diagram illustrating a configuration of a computing system for executing a method according to an embodiment of the present disclosure.

Referring to FIG. 10, a computing system 1000 may include at least one processor 1100, a memory 1300, a user interface input device 1400, a user interface output device 1500, storage 1600, and a network interface 1700, which are connected with each other via a bus 1200.

The processor 1100 may be a central processing unit (CPU) or a semiconductor device that processes instructions stored in the memory 1300 and/or the storage 1600. The memory 1300 and the storage 1600 may include various types of volatile or non-volatile storage media. For example, the memory 1300 may include a ROM (Read Only Memory) and a RAM (Random Access Memory).

Thus, the operations of the method or the algorithm described in connection with the embodiments disclosed herein may be embodied directly in hardware or a software module executed by the processor 1100, or in a combination thereof. The software module may reside on a storage medium (that is, the memory 1300 and/or the storage 1600) such as a RAM, a flash memory, a ROM, an EPROM, an EEPROM, a register, a hard disk, a removable disk, and a CD-ROM. The exemplary storage medium may be coupled to the processor 1100, and the processor 1100 may read information out of the storage medium and may record information in the storage medium. Alternatively, the storage medium may be integrated with the processor 1100. The processor 1100 and the storage medium may reside in an application specific integrated circuit (ASIC). The ASIC may reside within a user terminal In another case, the processor 1100 and the storage medium may reside in the user terminal as separate components.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

The vehicle and the vehicle idle notification system and method according to an embodiment of the present disclosure may notify the user of the idle of the vehicle according to the driving state of the vehicle or whether the occupant is detected, updates a setting value of a timer for the idle notification with a setting value set by the user, stores the idle notification value based on the latest user request information and perform control to stop the idle when requested by the user.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A vehicle idle notification system, comprising:

a vehicle configured to transmit idle status information to a server when it is determined that an operation condition of an idle notification timer is satisfied based on a driving state and whether an occupant is detected in the vehicle; and the server configured to transmit the idle status information to a mobile terminal, wherein the vehicle determines that the operation condition of the idle notification timer is satisfied when the occupant is not detected in the idle status, and a condition to reset the idle notification timer is satisfied when the occupant is detected in the idle status, wherein the server receives a start-OFF message from the mobile tenminal, wherein the start-OFF message is input through the mobile terminal, and wherein the vehicle receives the start-OFF message from the server and control to turn off the start operation based on the start-OFF message received from the server.

2. The vehicle idle notification system of claim 1, wherein the vehicle determines an idle status when it is determined that an ignition is in an ON state based on the driving state, the vehicle is in a stopped state and a shift gear is in a P-stage.

3. The vehicle idle notification system of claim 1, wherein the server compares a first setting value of the idle notification timer received from the mobile terminal and a second setting value set in advance in the idle notification timer, generates a comparison result, and transmits the comparison result to the vehicle.

4. The vehicle idle notification system of claim 3, wherein the vehicle performs control such that the idle notification timer operates at the first setting value when the operation condition of the idle notification timer is satisfied and the first setting value is received from the server as the comparison result.

5. The vehicle idle notification system of claim 3, wherein the vehicle performs control such that the idle notification timer operates at the second setting value when the operation condition of the idle notification timer is satisfied and a message for maintaining the second setting value is received from the server as the comparison result.

6. The vehicle idle notification system of claim 1, wherein the vehicle resets the first setting value or the second setting value to an initial setting value when it is determined that the condition to reset the idle notification timer is satisfied.

7. The vehicle idle notification system of claim 6, wherein the idle status information includes operation information of the idle notification timer and information indicating whether the occupant is detected.

8. A vehicle, comprising:

a sensor configured to detect a driving state and an occupant in the vehicle; and a controller configured to control an operation of an idle notification timer based on a setting value of the idle notification timer received from a server when it is determined that an operation condition of the idle notification timer is satisfied based on the driving state and whether the occupant is detected in the vehicle, wherein the vehicle determines that the operation condition of the idle notification timer is satisfied when the occupant is not detected in the idle status, and a condition to reset the idle notification timer is satisfied when the occupant is detected in the idle status, wherein the controller is configured to recieve a start-OFF message from the server and control to turn off the start operation based on the start-OFF message received from the server, and wherein the start-OFF message is input through a mobile terminal, the server receives the start-OFF message from the mobile terminal.

* * * * *